US010710226B2

(12) United States Patent
Lin

(10) Patent No.: US 10,710,226 B2
(45) Date of Patent: Jul. 14, 2020

(54) SAFE NAIL GUN

(71) Applicant: EVERWIN PNEUMATIC CORPORATION, Taichung (TW)

(72) Inventor: Chien-Hung Lin, Taichung (TW)

(73) Assignee: EVERWIN PNEUMATIC CORPORATION, Taichung (TW)

( * ) Notice: Subject to any disclaimer, the term of this patent is extended or adjusted under 35 U.S.C. 154(b) by 186 days.

(21) Appl. No.: 15/977,121

(22) Filed: May 11, 2018

(65) Prior Publication Data

US 2019/0344414 A1 Nov. 14, 2019

(51) Int. Cl.
*B25C 1/00* (2006.01)
*B25C 1/04* (2006.01)

(52) U.S. Cl.
CPC ..... *B25C 1/008* (2013.01); *B25C 1/047* (2013.01)

(58) Field of Classification Search
CPC ..... B25C 1/008; B25C 1/047
USPC ..... 227/8, 131, 130, 136, 156
See application file for complete search history.

(56) References Cited

U.S. PATENT DOCUMENTS 6,199,739 B1 * 3/2001 Mukoyama ..... B25C 1/008 227/120
6,974,062 B2 * 12/2005 Akiba ..... B25C 1/008 227/130
7,484,647 B2 * 2/2009 Yang ..... B25C 1/008 227/129
7,506,787 B2 * 3/2009 Wu ..... B25C 1/008 227/120

* cited by examiner

*Primary Examiner* — Nathaniel C Chukwurah
(74) *Attorney, Agent, or Firm* — Muncy, Geissler, Olds & Lowe, P.C.

(57) ABSTRACT

A safe nail gun includes a main body, a safety unit, a trigger device, and a clutch unit. The clutch unit has a moving member, a guide piece, and a retainer. The guide piece has a moving segment and a detaching segment. The moving member is connected to the retainer. Upon operation of the trigger device, the retainer drives the safety unit to slide along the moving segment. When one end of the safety unit abuts against an object, the trigger device is enabled to activate ejection of a nail into the object. When the trigger device is continuously operated and the safety unit does not contact an object, the retainer slides from the moving segment to the detaching segment, so the trigger device is disabled to activate ejection of any more nail, thereby ensuring safe use of the nail gun.

8 Claims, 6 Drawing Sheets

SAFE NAIL GUN

1. TECHNICAL FIELD

The present invention relates to nail guns, and more particularly to a safe nail gun.

2. DESCRIPTION OF RELATED ART

A conventional nail gun typically comprises a main body and a trigger attached to the main body. When the trigger is operated, a nail is ejected through a nose formed on the main body.

For preventing unintentional triggering or improper use of the nail gun, a safety mechanism that moves between a non-firing position and a firing position is known to be provided at the nose of the nail gun. When the nail gun is not in use, the safety mechanism projects from the nose and is in the non-firing position. At this time, the trigger becomes inoperable or is operable yet unable to eject a nail. When the nail gun abuts against a working surface, the safety unit is pushed by the working surface to the firing position, where a user can operate the trigger to eject a nail.

U.S. Pat. No. 6,974,062 B2 teaches a nail gun with safety portion mechanism for preventing misfires. The nail gun has a free end and central portion of a trigger arm positioned within a trigger, on an upper end of a safety portion and at a plunger, respectively. When the trigger is pivoted on its pivot end, pivoting movement of the trigger moves a pivot end of the trigger arm to press the central portion of the trigger arm into contact with the plunger and, with the plunger serving as a fulcrum, to press the free end downward against the upper end of the safety portion. If downward movement of the safety portion is obstructed when the trigger is pivoted, the upper end contacted by the free end of the trigger arm serves as a fulcrum around which the trigger arm pivots with movement of the trigger, whereupon the central portion of the trigger arm presses the plunger inward so that an activation switch activates a blade to eject a nail through a nose piece.

However, the known mechanism is relatively complicated and tends to cause interference among components and harsh operation, which can significantly degrade its effectiveness of preventing misfire.

SUMMARY OF THE INVENTION

Hence, the object of the present invention is to provide a safe nail gun.

In one aspect of the present invention, a safe nail gun comprises: a main body, having an ejection portion that has one end provided with a nose piece and an ejection hole that is defined in the ejection portion and communicated with the nose piece, wherein the ejection portion is connected to a magazine that supplies a nail to the ejection hole each time; a safety unit, being installed in the main body and configured to move with respect to the ejection portion when operated; a trigger device, being installed in the main body and configured to activate ejection of the nail; and a clutch unit, being provided between the safety unit and the trigger device and having a moving member, a guide piece and a retainer, guide piece has a moving segment and a detaching segment, wherein when the trigger device is operated, the moving member drives the retainer to draw the safety unit to slide along the moving segment, so that when one end of the safety unit abuts against an external object, counterforce from the object acts on the retainer through the safety unit, and the trigger device is able to activate ejection of the nail into the object; and when the trigger device is continuously operated and the safety unit does not contact the object, the retainer slides from the moving segment to the detaching segment, and the trigger device is unable to activate ejection of a next nail.

With the foregoing configuration, when the trigger device is operated, the retainer moves between the moving segment and the detaching segment, so as to change the connection between the safety unit and the retainer, and only when the main body abuts against an object, the counterforce can act on the trigger device through the moving member to enable the trigger device to activate ejection of the nail into the object, so as to ensure safe use.

Moreover, compared to the prior art, the present invention uses a simpler structure to ensure smoother operation and prevent interference among its components, so as to effectively eliminate the risk of misfire as seen in the conventional devices.

DETAILED DESCRIPTION OF THE INVENTION

Figure 1:
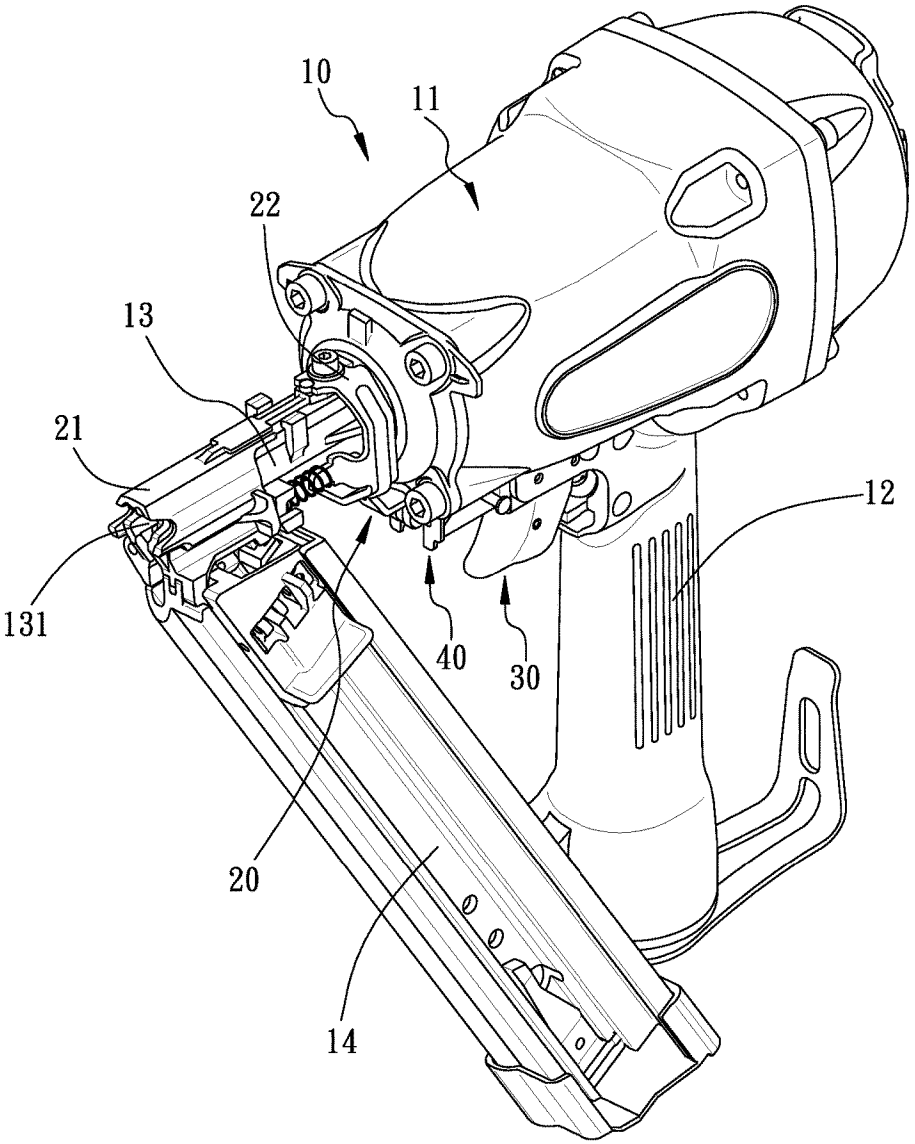
FIG. 1 is a perspective view of a nail gun of the present invention.
Figure 2:
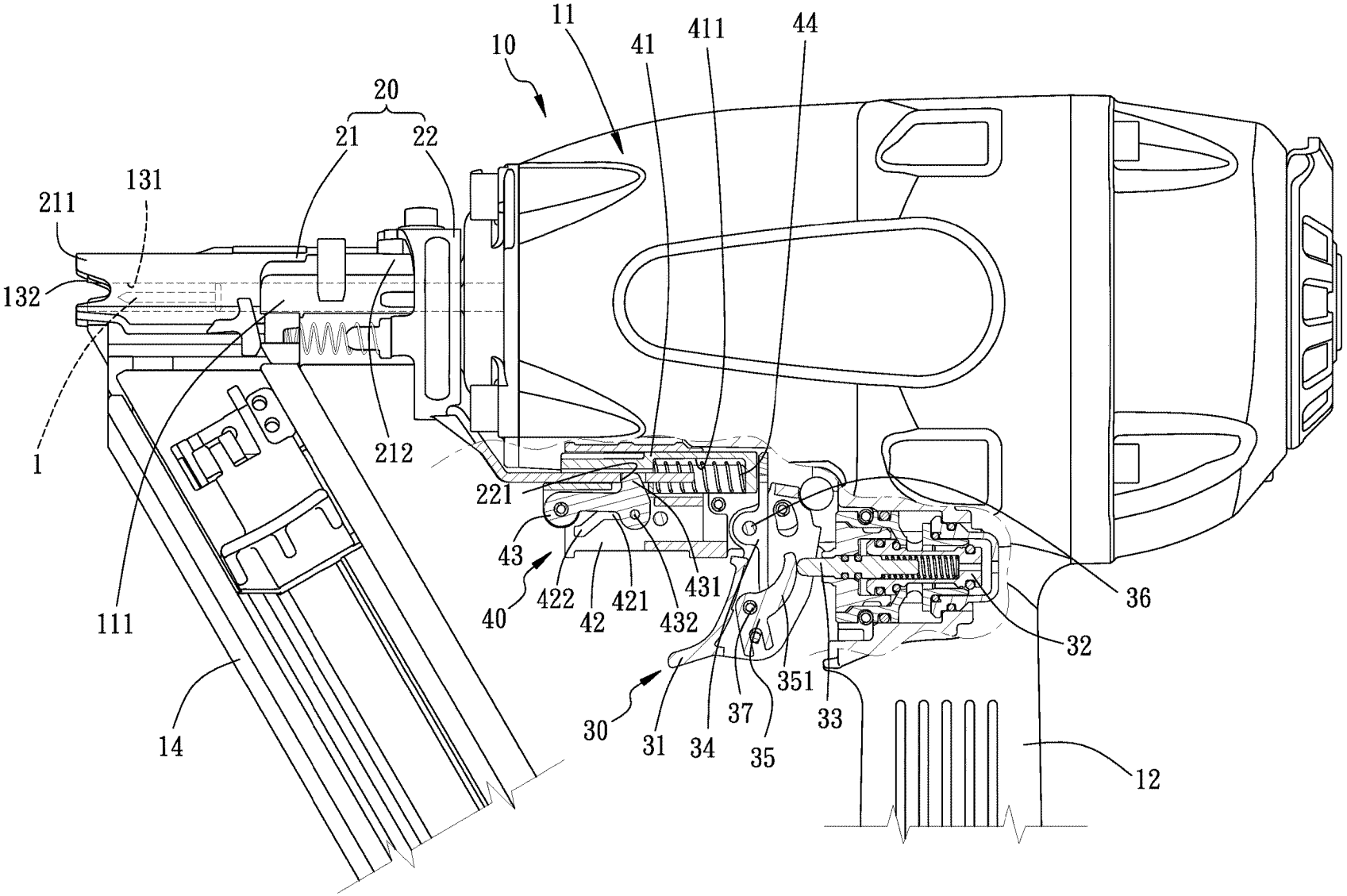
FIG. 2 is a partial, cross-sectional view of the nail gun of FIG. 1.
Figure 3:
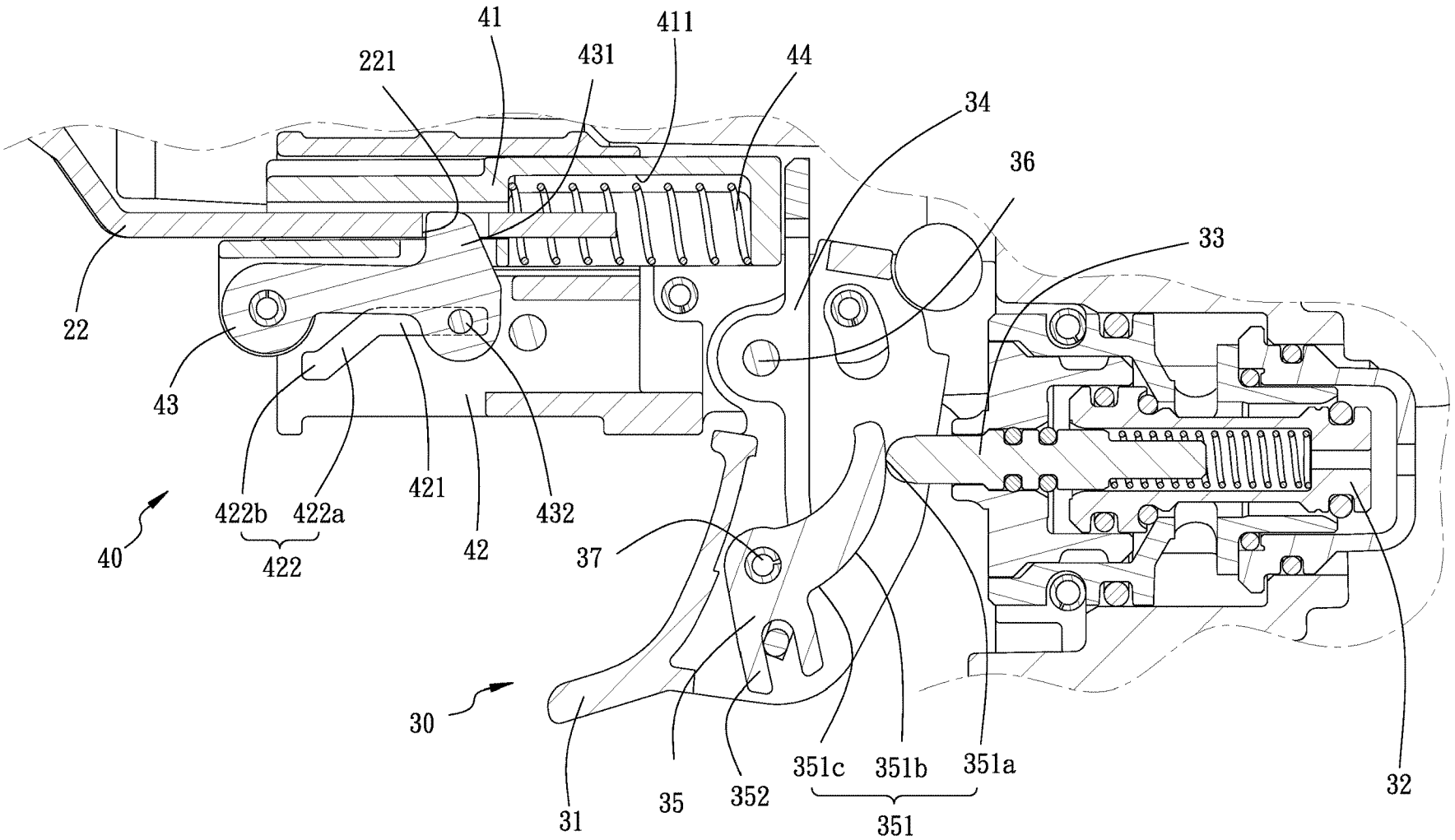
FIG. 3 is a partial, enlarged view of FIG. 2.
Figure 4:
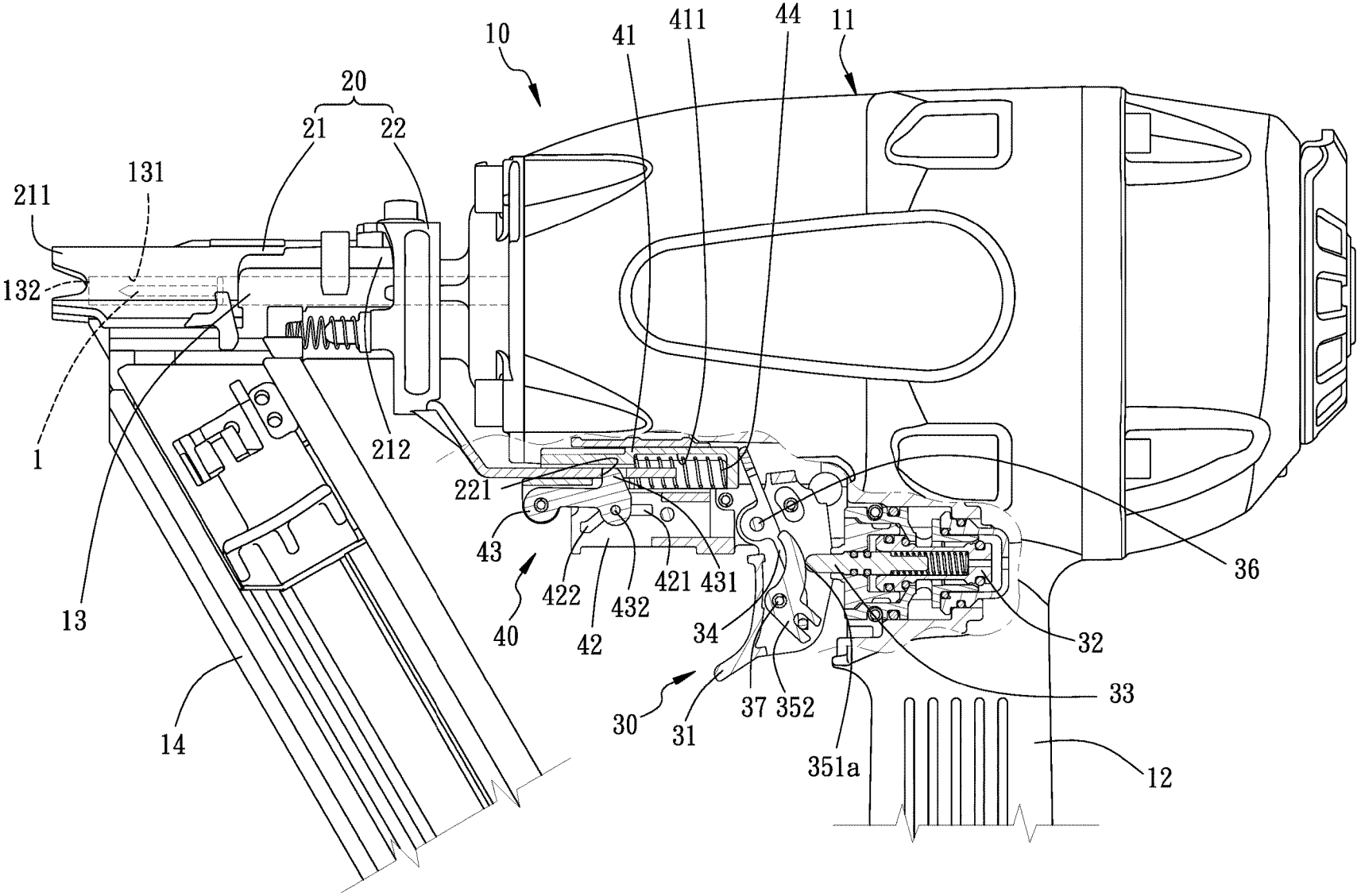
FIG. 4, similar to FIG. 2, shows the nail gun is triggered while its nose piece and slide does not abut against an object.

The following preferred embodiments when read with the accompanying drawings are made to clearly exhibit the above-mentioned and other technical contents, features and effects of the present invention. Through the exposition by means of the specific embodiments, people would further understand the technical means and effects the present invention adopts to achieve the above-indicated objectives. However, the accompanying drawings are intended for reference and illustration, but not to limit the present invention and are not made to scale.

Referring to FIG. 1 through FIG. 6, in the present invention, a safe nail gun comprises: a main body 10, a safety unit 20, a trigger device 30, and a clutch unit 40. The safety unit 20, the trigger device 30, and the clutch unit 40 are installed on the main body 10, while the clutch unit 40 is provided between the safety unit 20 and the trigger device 30.

The main body 10 has a head portion 11 and a handle 12. The head portion 11 and the handle 12 are connected to each other, with a chamber defined therebetween. The chamber is communicated with a pressured air source that supplies compressed air into the chamber. The head portion 11 has a nail driver (now shown). The head portion 11 has its front end provided with an ejection portion 13, and the nail driver is movably received in the ejection portion 13. The ejection portion 13 defines therein an ejection hole 131. The ejection portion 13 has its one end provided with a nose piece 132 that is communicated with the ejection hole 131. The ejection portion 13 is connected to a magazine 14, and the magazine 14 is communicated with the ejection hole 131.

The magazine 14 accommodates plural nails 1 and serves to deliver the nails 1 to the ejection hole 131 in sequence.

The safety unit 20 and the clutch unit 40 are installed near the head portion 11. The trigger device 30 is attached to the handle 12. The handle 12 is for a user to grip. The trigger device 30 controls entry of the compressed air into the chamber. The compressed air, when entering the chamber, drives the nail driver to hit the nail 1 in the ejection hole 131, thereby ejecting the nail 1 through the nose piece 132.

The safety unit 20 is configured to be operated and thereby move with respect to the ejection portion 13. The safety unit 20 has a slide 21 and a safety member 22. The slide 21 has a first end 211 and a second end 212 opposite to each other. The safety member 22 has its one end connected to the second end 212 of the slide 21 and has its opposite end provided with a notch 221. The notch 221 is connected to the clutch unit 40. The safety member 22 is configured to be operated and thereby drive the slide 21 to slide along the ejection portion 13. The slide 21 has its first end 211 corresponding to the nose piece 132 and configured to abut against an object 2.

The trigger device 30 has a trigger 31, a valve block 32, a valve stem 33, a first acting member 34, and a second acting member 35. The valve stem 33 is slidably received in the valve block 32. The valve block 32 is communicated with the pressured air source. The valve stem 33 allows the valve block 32 to get communicated with the chamber, thereby allowing the compressed air from the pressured air source to enter the chamber. The first acting member 34 and the trigger 31 are pivotally connected to the main body 10 by means of a first pivot 36. The second acting member 35 is pivotally installed in the trigger 31 by means of a second pivot 37. The second acting member 35 has its one end engaged with one end of the first acting member 34. The opposite end of the first acting member 34 abuts against the clutch unit 40. The opposite end of the second acting member 35 contacts the valve stem 33. Thereby, when operated, the trigger 31 pivots against the first pivot 36, and in turn draws the second acting member 35 to pivot against the second pivot 37. The second acting member 35 then drives the first acting member 34 to push and move the clutch unit 40.

The second acting member 35 also has an operating portion 351 and a connecting portion 352. The connecting portion 352 is fork-like so that it is engaged with one end of the first acting member 34. The operating portion 351 contacts the valve stem 33. Therein, the operating portion 351 has a contact segment 351*a*, a pressing segment 351*b*, and a releasing segment 351*c*. When the contact segment 351*a* and the releasing segment 351*c* come into contact with the valve stem 33, the trigger device 30 is disabled to activate ejection of the nail 1. When the pressing segment 351*b* abuts against the valve stem 33, the trigger device 30 is enabled to activate ejection of the nail 1. In the present embodiment, the operating portion 351 is curved. The pressing segment 351*b* is located between the contact segment 351*a* and the releasing segment 351*c*. The releasing segment 351*c* is close to the second pivot 37. The operating portion 351 has its thickness gradually increased from the contact segment 351*a* through the pressing segment 351*b* to the releasing segment 351*c*.

The clutch unit 40 has a moving member 41, a guide piece 42, and a retainer 43. The moving member 41 has an acting recess 411. The safety member 22 has its one end received in the acting recess 411. A spring member 44 is provided between the acting recess 411 and the safety member 22. In the present embodiment, the spring member 44 is a compression spring. The spring member 44 has its preload acting on the safety member 22. The retainer 43 has its one end pivotally connected to the moving member 41, and has its opposite end provided with a retaining portion 431. The retainer 43 is slidably installed on the guide piece 42. The retaining portion 431 of the retainer 43 is detachably fit in the notch 221 of the safety member 22.

The guide piece 42 has a moving segment 421 and a detaching segment 422. The moving segment 421 and the detaching segment 422 form a non-linear groove. The retainer 43 has its one lateral formed with a raised guide pin 432. The guide pin 432 is configured to slide between the moving segment 421 and the detaching segment 422. The moving segment 421 is closer to the head portion 11 than the detaching segment 422 is. Therein, the detaching segment 422 has a linking portion 422*a* and a positioning portion 422*b*. The linking portion 422*a* connects the positioning portion 422*b* to the moving segment 421. The positioning portion 422*b* is located at the end of the linking portion 422*a*. In the present embodiment, the moving segment 421 is straight, so that the retainer 43 can shift with respect to the guide piece 42. The linking portion 422*a* is inclined downward from the handle 12 toward the head portion 11.

Referring to FIG. 1 through FIG. 5, when operated, the trigger 31 of the trigger device 30 pivots against the first pivot 36, and draws the second acting member 35 to pivot against the second pivot 37. As a result, the contact segment 351*a* of the operating portion 351 comes into contact with the valve stem 33. The pivot of the second acting member 35 drives the first acting member 34 to push the moving member 41 with its one end, so that the moving member 41 drives the retainer 43 to move toward the head portion 11. The guide pin 432 of the retainer 43 slides along the moving segment 421. The safety member 22 is driven by the retainer 43 to draw the slide 21 to move so that the first end 211 of the slide 21 projects from the nose piece 132. Then, when the first end 211 of the slide 21 abuts against the object 2. The counterforce from the object 2 acts on the retainer 43 through the safety unit 20. The guide pin 432 of the retainer 43 slides from the moving segment 421 to where the moving segment 421 borders the linking portion 422*a*. At this time, the first end 211 of the slide 21 abuts against the object 2 and is prevented from moving anymore, while the retainer 43 and the moving member 41 cannot move, so the safety member 22 is secured from moving. Since the trigger 31 is continuously triggered, the end of the first acting member 34 abutting against the moving member 41 is not allowed to move. The triggering force acting on the trigger 31 makes the second acting member 35 pivot against the second pivot 37, so the pressing segment 351*b* of the operating portion 351 pushes the valve stem 33 to move inward. Consequently, the valve stem 33 allows the valve block 32 and the chamber come into communication, so the compressed air of the pressured air source enters the chamber and drives the nail driver to hit the nail 1 in the ejection hole 131, thereby ejecting the nail 1 into the object 2 via the nose piece 132.

Figure 5:
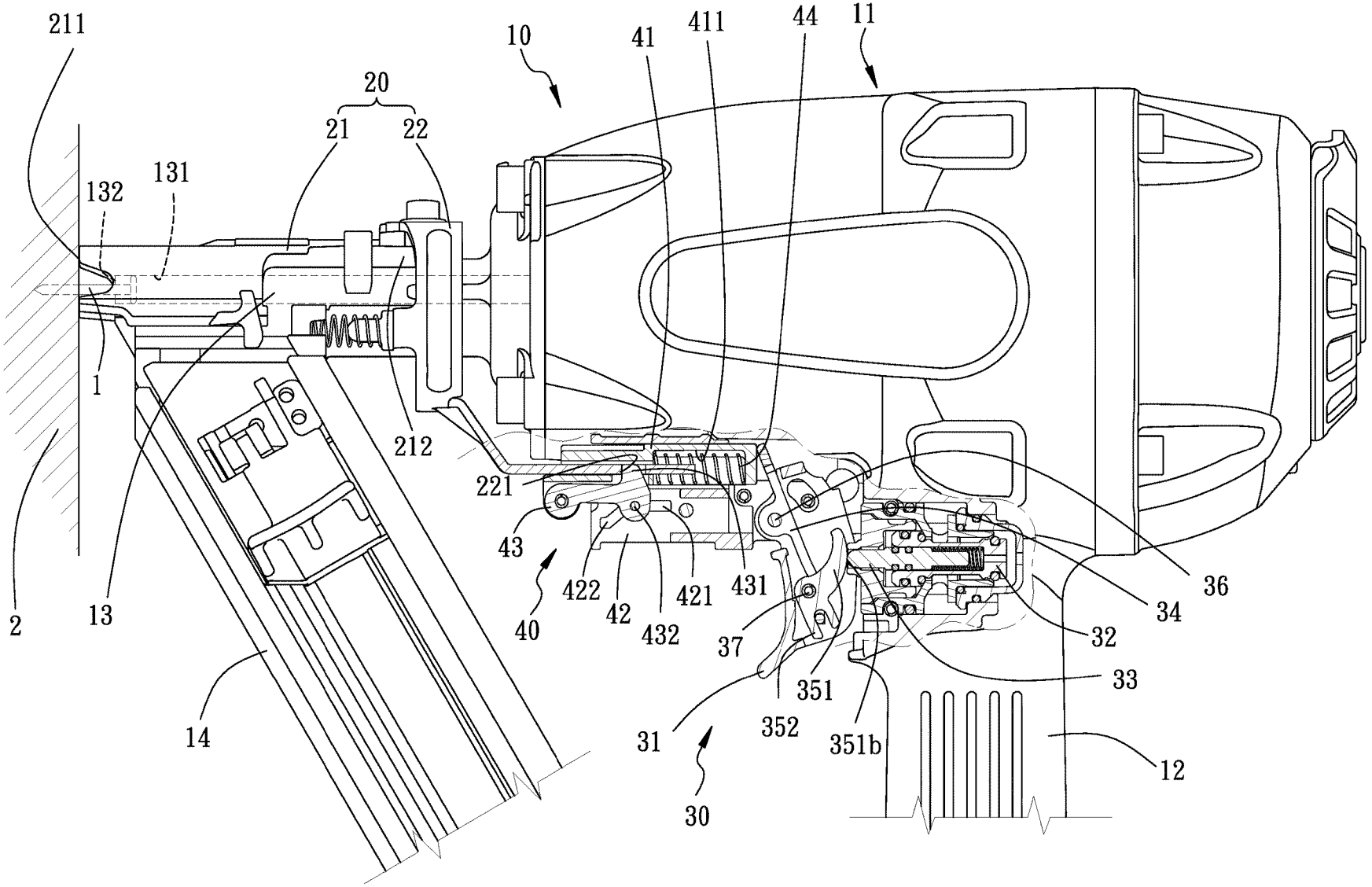
FIG. 5, similar to FIG. 4, shows the nail gun is triggered while its nose piece and slide abut against an object.
Figure 6:
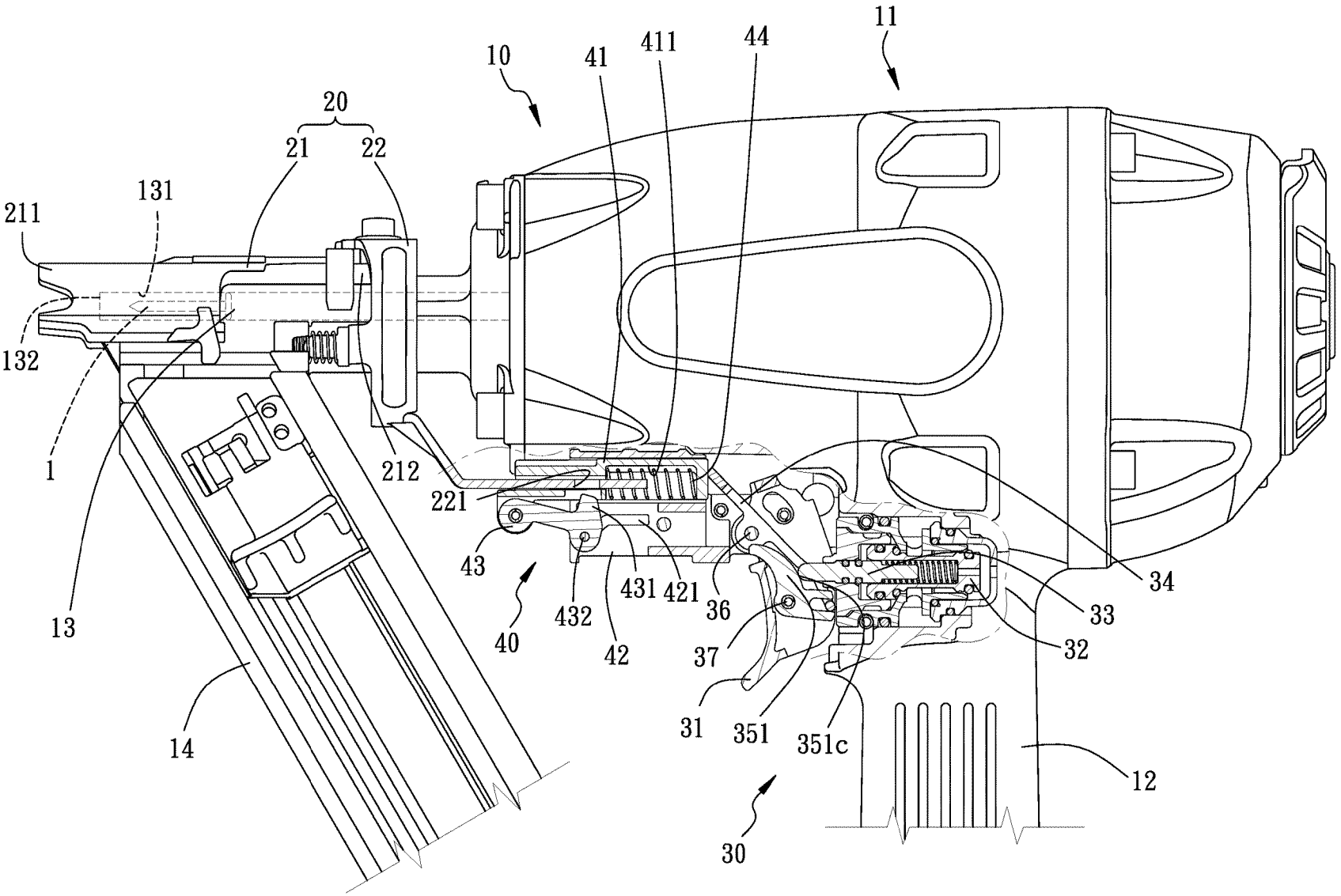
FIG. 6, similar to FIG. 5, shows the nail gun has ejected a nail and its nose piece and slide does not abut against an object.

Referring to FIG. 5 and FIG. 6, when the trigger 31 of the trigger device 30 is continuously operated, and the first end 211 of the slide 21 does not abut against an object 2. Since there is no counterforce from an object 2, the safety member 22 is affected by the preload of the spring member 44 to make the first end 211 of the slide 21 project from the nose piece 132, and the moving member 41 is pushed by the first acting member 34 to drive the retainer 43 to move with respect to the main body 10, thereby making the guide pin 432 of the retainer 43 slide from where the moving segment 421 borders the linking portion 422*a* to the positioning portion 422*b* of the detaching segment 422 along the linking portion 422*a*. The retaining portion 431 of the retainer 43 is now not engaged with the notch 221 of the safety member 22, with the relation therebetween eliminated. As a result, the safety unit 20 is no more affected by the clutch unit 40. At this time, the second acting member 35 pivot against the second pivot 37, so the operating portion 351 moves from the pressing segment 351*b* to the releasing segment 351*c*, and the valve stem 33 projects to come into contact with the releasing segment 351*c* again. The valve stem 33 thus demolishes the communication between the valve block 32 and the chamber, so the trigger device 30 is unable to activate ejection of the nail 1.

In addition, when the trigger 31 of the trigger device 30 is operated, the contact segment 351*a* of the operating portion 351 contacts the valve stem 33. The second acting member 35 pivots and drives the end of the first acting member 34 to push the moving member 41, so the moving member 41 drives the retainer 43 to move. The safety member 22 is driven by the retainer 43 to draw the slide 21 to move, so the first end 211 of the slide 21 projects from the nose piece 132 but does not abuts against object 2. At this time, the guide pin 432 of the retainer 43 slides to the detaching segment 422. Two ends of the spring member 44 abut against the safety member 22 and the inner wall of the acting recess 411, respectively. The force from the trigger 31 is unable to make the operating portion 351 of the second acting member 35 push the valve stem 33, so the communication between the valve block 32 and the chamber is not established and the nail 1 cannot be ejected. Thereby, the preload of the spring member 44 serves to prevent the second acting member 35 from acting, thereby preventing misfire caused by unintentional triggering.

With the guide pin 432 of the retainer 43 moving between the moving segment 421 and the detaching segment 422, the disclosed nail gun controls the connection between the safety unit 20 and the retainer 43, so that only when the main body 10 abuts against an object 2 and the counterforce acts on the trigger device 30 through the moving member 41 to communicate the valve block 32 of the trigger device 30 with the chamber, the compressed air of the pressured air source can enter the chamber and drive the nail driver to hit and eject the nail in the ejection hole 131, thereby providing improved safety in use.

Moreover, the present invention uses a simple structure to ensure smooth operation and prevent interference among its components, so as to effectively eliminate the risk of misfire.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A safe nail gun, comprising:

a main body, having an ejection portion that has one end provided with a nose piece, and an ejection hole that is defined in the ejection portion and communicated with the nose piece, wherein the ejection portion is connected to a magazine that supplies a nail to the ejection hole each time;

a safety unit, being installed in the main body and configured to move with respect to the ejection portion when operated, the safety unit having a slide and a safety member, and one end of the safety member is provided with a notch;

a trigger device, being installed in the main body and configured to activate ejection of the nail; and a clutch unit, being provided between the safety unit and the trigger device, with the safety member being connected between the clutch unit and the slide; the clutch member has a moving member, a guide piece that has a moving segment and a detaching segment, and a retainer, the retainer is connected to the safety member to drive the slide to move with respect to the ejection portion; one end of the retainer is pivotally connected to the moving member, and an opposite end of the retainer is provided with a retaining portion which-is detachably fitted in the notch, wherein when the trigger device is operated, the moving member drives the retainer to draw the safety unit to slide along the moving segment, so that when one end of the safety unit abuts against an external object, counterforce from the object acts on the retainer through the safety unit, and the trigger device is able to activate ejection of the nail into the object, and when the trigger device is continuously operated and the safety unit does not contact the object, the retainer slides from the moving segment to the detaching segment, and the trigger device is unable to activate ejection of a next nail.

2. The safe nail gun of claim 1, wherein the moving segment and the detaching segment form a non-linear groove, and the retainer has one lateral side provided with a raised guide pin, so that the guide pin slides between the moving segment and the detaching segment.

3. The safe nail gun of claim 2, wherein the detaching segment has a linking portion and a positioning portion, in which the linking portion communicates the positioning portion with the moving segment, so that when the safety unit abuts against the object, the guide pin of the retainer is located at where the moving segment borders the linking portion, and the retainer moves to the positioning portion, so the trigger device is unable to activate ejection of the nail.

4. The safe nail gun of claim 1, wherein the moving member has an acting recess, and the safety member has one end thereof received in the acting recess and an opposite end thereof connected to the slide, while a spring member is provided between the acting recess and the safety member.

5. The safe nail gun of claim 1, wherein the trigger device has a trigger, a first acting member and a second acting member, in which the first acting member and the trigger are pivotally connected to the main body by means of a first pivot, and the second acting member is pivotally connected to the trigger by means of a second pivot, while the first acting member has one end thereof connected to one end of the second acting member and an opposite end thereof abutting against the moving member, so that when the trigger is operated, the trigger pivots against the first pivot and draws the second acting member to pivot against the second pivot, thereby driving the first acting member to push the moving member.

6. The safe nail gun of claim 5, wherein the trigger device has a valve block configured to get communicated with a pressured air source and a valve stem slidably received in the valve block, and the second acting member has an operating portion and a connecting portion, in which the connecting portion is engaged with one end of the first acting member, and the operating portion contacts the valve stem, so that when the trigger is operated, the operating portion abuts against the valve stem to make the valve block communicate with the pressured air source.

7. The safe nail gun of claim 6, wherein the operating portion has a contact segment, a pressing segment, and a releasing segment, and when the contact segment and the releasing segment come into contact with the valve stem, the trigger device is unable to activate ejection of the nail, while when the pressing segment abuts against the valve stem, the trigger device is able to activate ejection of the nail.

8. The safe nail gun of claim 7, wherein the operating portion is curved; the pressing segment is located between the contact segment and the releasing segment; the releasing segment is close to the second pivot; and the operating portion has a thickness gradually increased from the contact segment to the releasing segment through the pressing segment.

* * * * *